US005221522A

United States Patent [19]

Cash

[11] Patent Number: 5,221,522

[45] Date of Patent: Jun. 22, 1993

[54] REGENERATIVE THERMAL OXIDIZER WITH INLET/OUTLET CROSSOVER DUCT

[75] Inventor: James T. Cash, Hackettstown, N.J.

[73] Assignee: Regenerative Environmental Equipment Co., Inc., Morris Plains, N.J.

[21] Appl. No.: 829,940

[22] Filed: Feb. 3, 1992

[51] Int. Cl.[5] ..... B01D 50/00

[52] U.S. Cl. ..... 422/171; 422/173; 422/175; 422/182; 431/5; 431/7; 432/181; 432/182; 423/210; 110/210

[58] Field of Search ..... 422/171, 173, 174, 175, 422/176, 177, 182; 110/210, 211, 212, 214; 432/72, 181, 182; 431/5, 7, 170, 202, 326; 423/210

[56] References Cited

U.S. PATENT DOCUMENTS

| | | | |
|---|---|---|---|
| 3,634,026 | 1/1972 | Kuechler et al. | 423/210 |
| 3,895,918 | 7/1975 | Mueller | 423/175 |
| 4,248,841 | 2/1981 | Benedick | 423/210 |
| 4,252,070 | 2/1981 | Benedick | 110/211 |
| 4,302,426 | 11/1981 | Benedick | 422/173 |
| 4,474,118 | 10/1984 | Benedick | 110/211 |
| 4,650,414 | 3/1987 | Grenfell | 43/5 |
| 4,658,853 | 4/1987 | Pennington | 137/240 |
| 4,671,346 | 6/1987 | Masters et al. | 165/9.3 |
| 4,779,548 | 10/1988 | Mueller et al. | 110/336 |
| 4,793,974 | 12/1988 | Hebrank | 422/175 |
| 4,961,908 | 10/1990 | Pennington et al. | 422/173 |
| 5,024,817 | 6/1991 | Mattison | 422/111 |
| 5,026,277 | 6/1991 | York | 432/181 |

*Primary Examiner*—Robert J. Warden

*Assistant Examiner*—Christopher Y. Kim

*Attorney, Agent, or Firm*—Howrey & Simon

[57] ABSTRACT

A regenerative thermal oxidizer for removing pollutants from industrial exhaust gas flows by high temperature oxidation is composed of at least two regenerative units having a modular construction and a much more compact design than previously achieved in units of comparable size. The more compact design is achieved without any sacrifice in thermal efficiency by providing a regenerative bed having one hot-face area and two cold-face areas connected by an inlet/outlet crossover duct. The bed has "w"-shaped cross-section to support and contain interlocking heat-exchange elements without the use of hot-face or cold-face area retaining members. Each unit has inlet and outlet flow dividing mechanisms, an inlet duct, and an outlet duct. The inlet duct contains the inlet flow dividing mechanism and communicates with an inlet manifold and the cold-face areas for conducting process gas to the cold-face areas during inlet mode. The outlet duct contains the outlet flow dividing mechanism and communicates with an outlet manifold and the cold-face areas for conducting oxidized air flowing away from the purification chamber to the cold-face areas during outlet mode. The crossover duct forms part of the inlet duct during inlet mode and part of the outlet duct during outlet mode. The design of the crossover duct produces a small flushing volume and may include a flushing valve disposed intermediate the crossover duct for introducing a flushing volume of air through the bed via two separate flow paths.

24 Claims, 9 Drawing Sheets

REGENERATIVE THERMAL OXIDIZER WITH INLET/OUTLET CROSSOVER DUCT

BACKGROUND OF THE INVENTION

The invention relates in general to thermal regeneration apparatus for high temperature oxidation of pollutants in exhaust gas flows of industrial systems. More particularly, it relates to an improved regenerative thermal oxidizer that is more compact and more modular in construction than commercially available regenerative apparatus of comparable capacity by virtue of its having two cold-face areas per regenerative bed, which are in flow communication via an inlet/outlet crossover duct.

Purification of exhaust gas flow streams by regenerative thermal oxidization has been known for some time. Typically, regenerative oxidization apparatus includes at least two regenerative chambers containing heat exchange elements and a burner for heating the gas and oxidizing pollutants contained therein. In such an apparatus, gas to be purified is conducted to one of the regenerative chambers, which preheats the gas by virtue of a previous heat exchange step. From this inlet or gas heating regenerator, the gas flows to a high temperature combustion chamber containing one or more burners for oxidizing the pollutants in the gas. The gas is conducted from the combustion chamber to an outlet or cooling regenerative chamber, which cools the gas as heat from the gas is transferred to its heat exchange elements. The purified and cooled gas then is led to an exhaust stack for venting to atmosphere. Following a predetermined time cycle, the flow of gas through the regenerative system then is reversed. The outlet cooling gas regenerator now becomes the inlet heating regenerator and the previous inlet regenerator now functions as the outlet regenerator, which cools the gas prior to exhaust. The heat transferred to the outlet regenerator is recaptured by its stoneware, and used to preheat the inlet gas during the next cycle.

Regenerative oxidization apparatus may have only two regenerative chambers, such as disclosed in U.S. Pat. Nos. 4,671,346 to Masters et al. and 5,024,817 to Mattison. However, three-chamber designs, such as those disclosed in U.S. Pat. Nos. 3,895,918 to Mueller and 5,026,277 to York, deceased, are commonly employed to alleviate the problem of unburned gases in the inlet regenerator being released upon a reversal of flow cycles. As exemplified by these patents, regenerative oxidizer systems may incorporate at least three regenerative chambers with the odd chamber being in a dead or idle mode in which there is no flow to or from this chamber. During the dead mode, the gas present in the inlet regenerator is purged to prevent the release of untreated gases to atmosphere.

The last two mentioned patents also represent the two basic types of regenerative oxidizers in commercial use today—the horizontal flow type and the vertical flow type. In the horizontal flow type oxidizer, gas flows horizontally through the regenerative chambers, as is apparent from FIG. 11, which is a reproduction of FIG. 1 of U.S. Pat. No. 4,779,548 to Mueller et al. FIG. 11 shows a number of regenerative chambers 12' arranged radially about and in flow communication with a central high-temperature combustion chamber 11'. Each regenerative chamber comprises a bed of heat exchange elements confined by a radially inner retaining wall 13' at the hot-face area of the bed and a radially outer retaining wall 14' at the cold-face area of the bed. Loading of and access to the stoneware is provided by doors 15' located at the top of the chambers. Although not readily apparent from FIG. 11, FIG. 2 of the '548 patent and FIG. 2 of U.S. Pat. No. 3,895,918 show the regenerative chambers having cross-sectional flow areas that are tapered inwardly in a direction from the inner hot-face retaining wall to the outer cold-face retaining wall. During operation, gas to be purified is conducted into an inlet duct ring 24', which distributes the gas to the inlet regenerative chamber, i.e., the chamber having its inlet valve 30' in the open position. The gas then flows past the inlet valve into a vertical duct 19' adjacent the cold-face retaining wall 14' and flows horizontally through the regenerative chamber and the inner hot-face retaining member 13' into the central combustion chamber 11' where it is purified by high-temperature oxidation. The gas is then pulled through the outlet regenerative chamber, which cools the purified gas, and an exhaust duct ring 27' via an open outlet valve 30' of the outlet chamber. Before the next cycle of operation begins when the outlet regenerative chamber functions as the inlet regenerative chamber and vice-versa, the valves of the inlet regenerative chamber are closed and any residual gases in that chamber are flushed through the combustion chamber. This prevents residual unpurified gases from being drawn directly into the exhaust duct ring when the valves in the inlet chamber are reversed at the start of the next cycle.

The horizontal flow oxidizers of the above design work well and achieve high heat recovery efficiencies, typically 80–95%, due primarily to two reasons. First, the tapered design of the regenerative beds relieve pressure by providing an increasing cross-sectional area as the gas is heated when it flows from the cold-face to the hot-face area of the bed and a decreasing cross-sectional area as the gas is cooled when it flows in the opposite direction. Secondly, the flushing volume necessary to purge the regenerative bed is the smallest of any comparatively sized, commercially available oxidization apparatus to date, which improves destruction efficiency. However, despite these advantages, certain drawbacks in the horizontal flow design exist.

For example, for the industrial applications to which the invention is directed, a regenerative oxidizer typically must have a capacity capable of processing 2,000–25,000 s.c.f.m. (standard cubic feet per minute) of effluent at a heat recovery of 95%. For these capacities, the height of a horizontal flow oxidizer generally ranges from 10 feet to 20 feet while the width will be 25 feet. The height and width of these oxidizers results in considerable disadvantages and additional costs. First of all, these oxidizers must be shipped to the end user in a multitude of pieces and assembled on site because of the height and width limitations of standard truck deliveries. The general shipping size limitations are 13 feet-6 inches for the height when the unit is loaded on the truck and 12 feet for the width without the use of special, expensive escorts and 14 feet when the expensive escorts are employed. With these constraints, the combustion chamber, regenerative chambers, and the inlet and outlet manifold ducts of a typical industrial oxidizer must be shipped separately and the unit assembled on site. In addition, the height of the oxidizers necessitates the use of extensive platforming for access to components, such as the flow control valves and actuators, instruments, and stoneware loading doors (see the location of upper valves 30' and stoneware loading doors 15' in FIGS. 11and 12). The cost of the platforming is significant because it may constitute as much as 10% of the total cost of an industrial oxidizer, which typically may be $1 million or more. A more cost effective way to build and deliver an industrial regenerative oxidizer is to assemble as much of the oxidizer as possible in the factory and to minimize or eliminate the platforming. However, to date there is no commercially available regenerative oxidizer that is compact enough to be shipped by truck in modular regenerative units and can achieve the high heat recovery efficiencies of up to 95% in the given industrial capacities.

Another disadvantage of the horizontal flow oxidizer is the requirement for two retaining wall members, one at the hot-face area and another at the cold-face area of each regenerative chamber. These members are particularly susceptible to wear due to the high temperatures that must be endured and the exposure to corrosive gas that may occur in certain applications.

The flushing arrangement of the horizontal flow oxidizer also has certain drawbacks. As shown in FIG. 11, the minimum flushing volume that must be purged during flushing cycles consists of the vertical area 19' extending between the inlet and outlet valves 30', 30'. Using a typical industrial capacity of 10,000 s.c.f.m., the valves may be 2 feet in diameter and the length of the vertical duct 19' may be 10 feet long. This produces a volume of approximately 37 cubic feet, which, as demonstrated below, is less than the vertical flow oxidizers but still a considerable volume that must be flushed before each flow reversal. In addition, to ensure that the entire volume of unpurified gases in the bed 12' and duct 19' is flushed, a separate baffle member is usually provided to distribute the flushing air along the vertical extent of the cold-face retaining wall 14'. A typical baffle member comprises a perforated tube communicating with the flushing air, such as illustrated at 81' in FIG. 12, which shows a cross-sectional view through a regenerative chamber of a typical horizontal flow-type oxidizer.

The vertical flow type regenerative oxidizers generally are not as efficient as the aforementioned horizontal flow type and have certain other drawbacks. Examples of the vertical flow oxidizers are disclosed in U.S. Pat. Nos. 3,634,026 to Kuechler et al., 4,650,414 to Grenfell, 4,793,974 to Hebrank, and 5,026,277 to York, deceased. As illustrated in FIG. 13, which is a reproduction of FIG. 1 of U.S. Pat. No. 5,026,277, the vertical flow type of regenerative oxidizers comprise cylindrical cans 1'', 2'', 3'' connected to a common combustion chamber 41'' disposed thereabove. Each vertical can contains heat exchange material supported by a cold-face retaining member 4'' disposed above a large enclosed space 5'' having a diameter equal to the diameter of the can. During operation, gas to be treated flows through an inlet duct 19'' via an open inlet valve 10'' and space 5'' where it flows vertically upward through the inlet or heating regenerative can 1'' and into the combustion chamber 41''. The gas then flows across chamber 41'', vertically downward through the outlet or cooling regenerative can 3'' and into the larger enclosed space 5'', from where it flows to an exhaust duct 27'' via an open outlet valve. Before flow reversal occurs, the inlet regenerative can is purged by connecting it to a source of negative pressure, which causes gas to flow through this can in a direction away from the combustion chamber.

For vertical can type oxidizers having industrial capacities of 2,000–25,000 s.c.f.m. with 95% thermal efficiency recovery, the height of the oxidizer typically will range from 15–20 feet, while the width or diameter of each can typically ranges from 8–30 feet. Thus, the same truck shipment limitations discussed above apply equally to the vertical can oxidizers. The cans containing the regenerative heat exchange material, the manifolds, valves, and purification chamber all must be shipped separately and assembled on site. The vertical can design also suffers from the same disadvantage requiring the use of platforming to access the valves and other components mounted at the top portions of the oxidizer.

Another significant drawback of the vertical flow type oxidizers lies in their reduced efficiency compared to the horizontal flow type because the minimum flushing volume is much larger than that of a horizontal flow device of comparable capacity. Again using a typical industrial capacity of 10,000 s.c.f.m., the diameter of a vertical can of an oxidizer of the type disclosed in York typically would be about 7 feet, while the height of enclosed space 5'' under the can would be about 2 feet. This produces a minimum flushing volume of about 80 cubic feet, which is much more than the 37 cubic feet flushing volume of the 10,000 s.c.f.m. horizontal flow type oxidizer discussed above.

In addition, the vertical can oxidizers do not eliminate both hot-face and cold-face retaining members; at least a cold-face retaining member is needed, such as shown at 4'' in FIG. 13. The York oxidizer also employs additional components such as a second blower and attendant valves, conduits, etc. not required in the horizontal flow oxidizers because York uses negative pressure to purge the inlet regenerator rather than positive pressure.

In U.S. Pat. No. 3,634,026 to Kuechler et al., an embodiment is proposed in FIG. 4 that which apparently does not require the use of hot-face and cold-face retaining members. In this proposal, two regenerative flue chambers 61''' are defined by dividing walls 62''' and central wall 62a'''. The flues are in communication with a combustion chamber 64''' and a communication duct 66''' and or 67''', each of which must be provided with separate inlet and outlet ducts (and valves). To Applicant's knowledge, such a design was never marketed and appears to be a commercial impossibility. The slumping sides of heat-exchange material in ducts 66''' and 67''', as well as the large flow opening in ducts 66''' and 67''', the marrow flow opening between the bottom of dividing wall 62''' , and the bottom wall 72''', and the large flow areas of flues 61''', would produce extreme variations in air flow path lengths. Air flowing adjacent wall 62''' clearly has a much shorter flow path through the bed 63''' than air flowing adjacent wall 72''', which would result in intolerable heat exchange efficiencies. In addition, even if interlocking saddles were used as the heat-exchange material, the bed would not prevent the material from shifting due to vibrations occurring during shipping and/or during operation because of thermal contraction/expansion.

The foregoing demonstrates that there is a need for, and the invention is directed to the problems of providing, a regenerative thermal oxidizer having a capacity of 2,000–25,000 s.c.f.m. and a heat recovery efficiency rate of up to 95% that is shorter in height and more compact than commercially available oxidizers and has a modular regenerative unit construction that can be assembled in the factory and shipped via standard truck deliveries in one piece.

SUMMARY OF THE INVENTION

The thermal regenerative oxidizer of the invention satisfies this need and avoids the drawbacks of the prior art by providing a regenerative thermal oxidizer for removing pollutants from an industrial exhaust gas flow that includes at least two regenerative units of modular construction. An inlet manifold is provided for conducting gas to be purified to the regenerative units. A purification chamber has at least one burner for maintaining a temperature high enough to oxidize pollutants in the gas conducted thereto. An outlet manifold conducts gas oxidized in the purification chamber from the regenerative units to exhaust. Each regenerative unit includes a purification chamber section defining part of the purification chamber and a regenerative bed containing gas-permeable, heat-exchange elements in flow communication with the purification chamber. The regenerative bed has a hot-face area of heat-exchange elements disposed adjacent the purification chamber and two cold-face areas of heat-exchange elements disposed at separate positions most remote from the hot-face area with respect to the direction of gas flow through the regenerative bed. An inlet duct communicates with the inlet manifold and both cold-face areas for conducting gas to be oxidized to the cold-face areas during an inelt flow mode and an outlet duct communicates with the outlet manifold and both cold-face areas for conducting gas oxidized in said purification chamber away from the cold-face areas during an outlet flow mode.

In this manner, the invention provides a regenerative thermal oxidizer having a capacity of 2,000–25,000 s.c.f.m. and achieving heat recovery efficiencies as high as those achieved in the horizontal flow type oxidizers while at the same time meeting the height and width restrictions of standard truck shipments. Each regenerative bed is of a modular construction that can be assembled at the factory and shipped by truck in one piece. For a typical 10,000 s.c.f.m. oxidizer, three regenerative beds are employed having a height of about 10 feet and a width of about 12 feet. This compact design is accomplished by providing each regenerative beds with a "w"-shaped cross-section in which the two cold-face areas are provided at the ends of the legs of the "w" and the hot-face area is provided in the interior, central portion of the "w" cross-section. The legs of the "w"-shaped cross-section taper inwardly in a direction from the hot face to the cold face to accommodate for gas expansion and contraction as the temperature rises or decreases in inlet or outlet mode, thereby relieving pressure. The two cold faces are connected by an inlet/-outlet crossover duct, which provides for better air flow distribution through the regenerative bed by dividing the flow both in inlet and outlet modes into two separate flow paths.

The crossover duct forms part of the inlet duct conducting gas from the inlet manifold to both cold-face areas during the inlet mode of its regenerative unit and forms part of the outlet duct conducting gas from the purification chamber through both cold-face areas during the outlet mode when gas is conducted to the outlet manifold. The inlet duct of each regenerative bed may comprise an inlet manifold transition duct communicating with the inlet manifold, an inlet flow dividing mechanism such as a butterfly valve, and two cold-face transition ducts communicating with the cold-face areas of the bed. The inlet valve communicates directly with one of the cold-face transition ducts to form one of the inlet flow paths and indirectly via the crossover duct with the other cold-face transition duct to form the other inlet flow path. Similarly, the outlet duct from each regenerative bed may comprise an outlet manifold transition duct communicating with the outlet manifold, an outlet flow dividing mechanism such as a butterfly valve, and the two cold-face transition ducts. The outlet valve communicates directly with one of the cold-face transition ducts to form one of the outlet flow paths and indirectly via the crossover duct with the other cold-face transition duct to form the other outlet flow path. The inlet and outlet manifold transition ducts may be of similar construction, as may be the inlet and outlet valves.

The "w"-shaped cross-section of the regenerative bed incorporates both vertical and horizontal air flow components to reduce the height of the unit such that a 95% thermally efficient unit may be achieved with a regenerative bed height of only four to six feet above grade. The "w"-shaped design also securely holds the stoneware in place without the need for hot-face or cold-face retaining members and without risking movement of the stoneware after being installed, either by expansion or contraction of the stoneware from heat or from vibration caused by shipping the regenerative unit on a truck with the stoneware already in place. The removal, inspection, and servicing of the heat exchange media due to plugging or contamination is safe and easy because there is no hot-face or cold-face to remove and no chance for the stoneware to fall on the worker. Similarly, the reduced height of the unit eliminates the need for platforming and enables access doors to be provided at reasonable heights to service the unit. Furthermore, the "w"-shaped cross section of the regenerative bed allows a reduction in the gauge of steel used to fabricate its housing, and thus a reduction in the manufacturing costs for two reasons:

(1) The typical heat exchange packing, such as an interlock saddle, will exert outward loads in a manner similar to hydraulic loading, in that for each foot of elevation of heat recovery media a proportional increase in outward load is exerted at the base elevation. Since the "w"shape allows a long path through the heat exchange media (typically 8 foot average for 95% thermal recovery) at a reduced total elevation (under 6 feet) compared to prior vertical or horizontal flow units, a reduction of up to 25% in outward forces is achieved.

(2) The center of gravity of the heat exchange media will be approximately half the elevation of the vertical or horizontal flow unit. This results in a reduced overturning moment of the structure, and thus reduced structural stress.

The crossover duct of the invention enables the achievement of high thermal efficiencies partly due to the reduced chamber flushing volume of the crossover duct. More particularly, a small flushing valve is provided at a point intermediate the crossover duct. When the flushing valve is open, the air is split into two smaller flushing volumes instead of the one larger volume provided in conventional horizontal and vertical flow designs. The split flow is more efficient and enables the elimination of the baffle member typically required in the horizontal flow design. In addition to the crossover duct itself having only a small volume which must be flushed, the inlet and outlet valves are located closer to the cold-face areas than in the previous designs to produce a smaller volume between the valves that must be flushed. Also, the ends of the crossover duct may be sloped upwardly towards the valve to help reduce the flushing volume. The baffle member used to distribute the flushing volume is eliminated, largely due to the design of the cold-face transition ducts between the valves and cold-face areas. These ducts are tapered to provide a decreasing cross-sectional flow area in a direction away from the valve, thereby reducing the volume and assisting in distributing the flushing air by increasing the back pressure. Hence, the cold-face transition ducts force the flushing volume into the stoneware sooner than if the duct was not tapered, thereby eliminating the need for a baffle member to distribute the flushing air over the cold-face areas.

The performance increase of the invention compared to the vertical can design is significant because the flushing volume achieved is 40–50% less than that required in a comparable vertical can design and the vertical can design does not adjust the cross-sectional flow area through the regenerative bed. The performance of the regenerative oxidizer of the invention is better than that of horizontal flow oxidizers of comparable capacity because the flushing volume is decreased and the hot-face and cold-face retaining members and the flushing baffle have been eliminated. Because there are no retaining members there is no additional flow resistance to be accounted for due to such members and the serious problem of deterioration of the retaining member by corrosive fumes present in some applications is avoided. Depending on the gases involved, the fumes may auto-ignite in the regenerative bed. Auto-ignition is not a problem in the invention because there is no hot-face member holding the stoneware, which might deform under the high temperatures.

DETAILED DESCRIPTION

Figure 1:
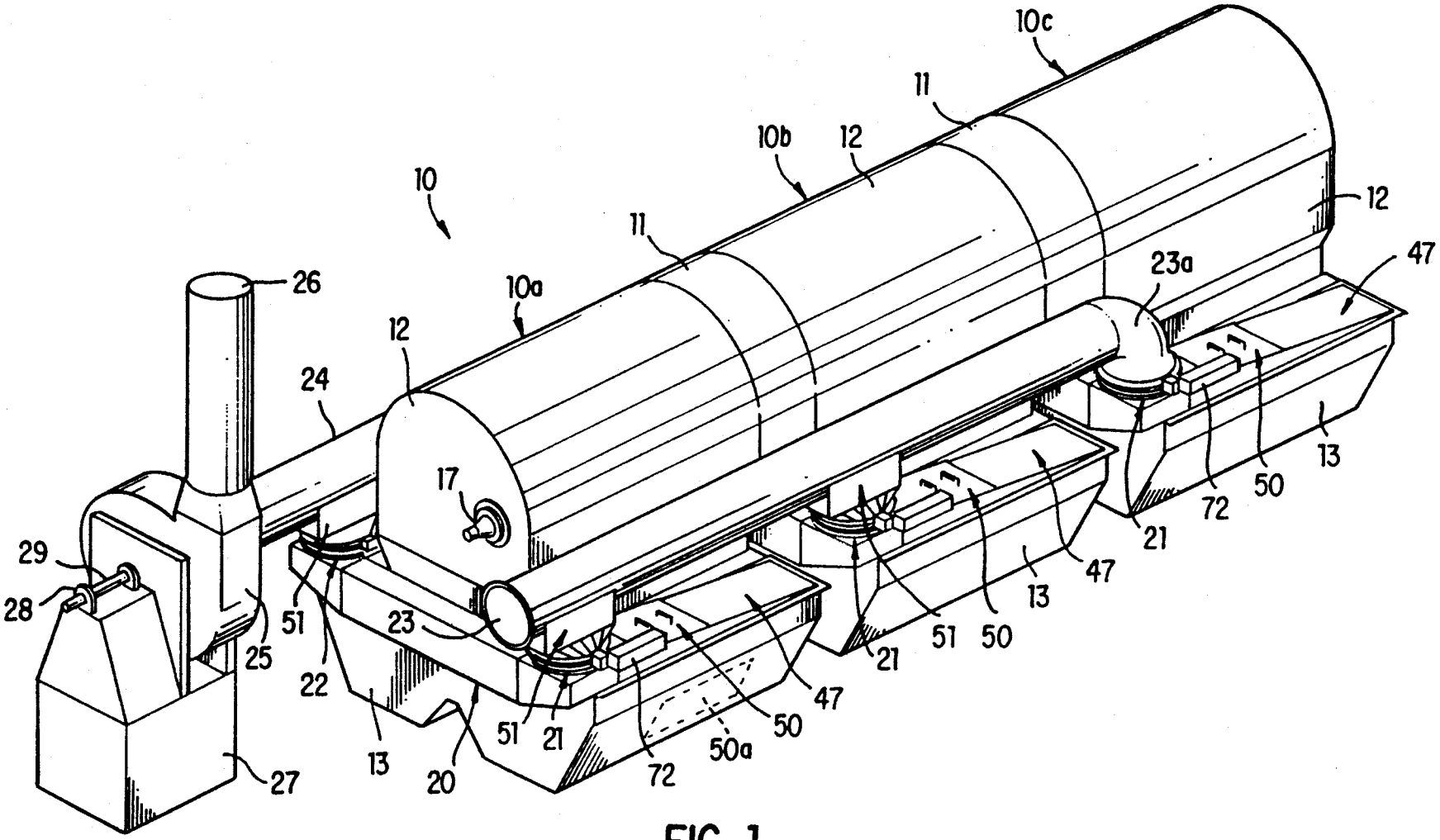
FIG. 1 is a perspective view of a regenerative thermal oxidizer constructed according to the principles of the invention in which the three modular regenerative units are prominently shown from the inlet manifold side of the oxidizer.
Figure 2:
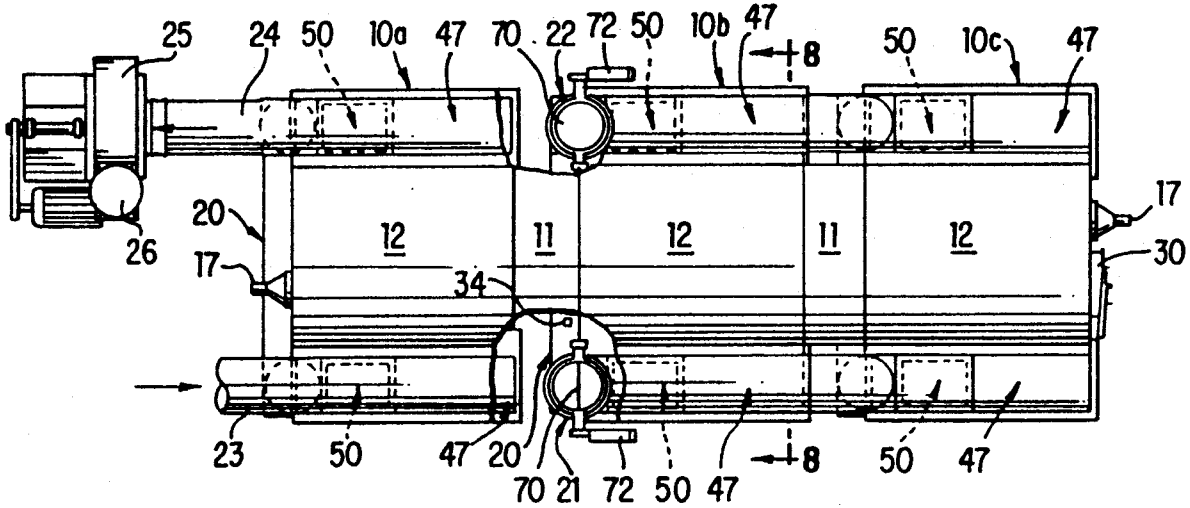
FIG. 2 is a plan view of the oxidizer shown in FIG. 1 with cut-aways illustrating the inlet and outlet manifold valves associated with one of the modular regenerative units.
Figure 3:
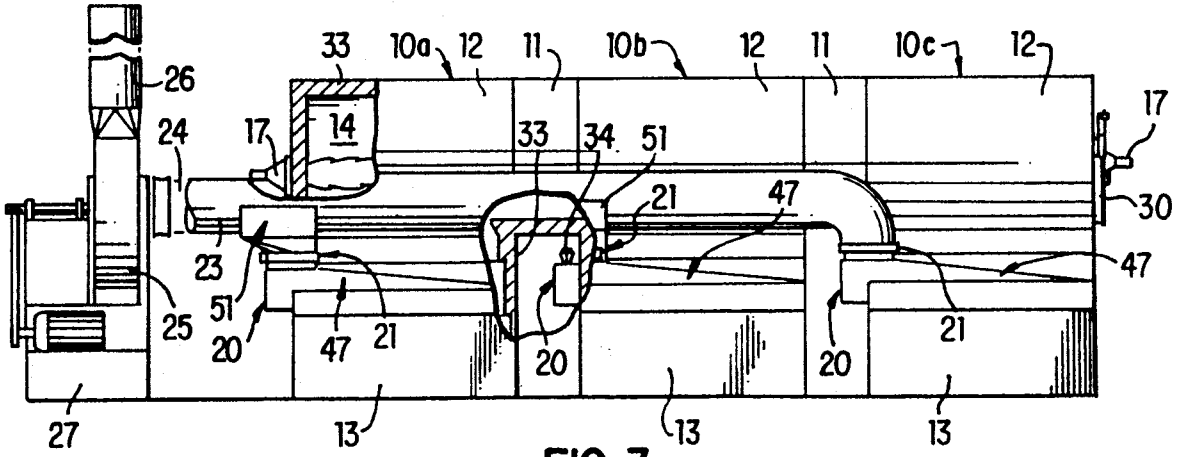
FIG. 3 is an elevational view of the oxidizer shown in FIG. 1 with cut-aways illustrating some of the insulation provided for the oxidizer.

As shown in FIGS. 1–3, the regenerative thermal oxidizer 10 of the invention includes three modular regenerative units 10*a*, 10*b*, and 10*c* of essentially similar construction. Each modular unit comprises a generally enclosed housing defined by a top portion 12 and a bottom portion 13. Top housing portion 12 defines a purification chamber section 14, while bottom housing portion 13 defines a regenerative bed 15 filled to a predetermined level with energy recovery or heat exchange elements ("stoneware") as shown best in FIGS. 8A–8B. The top housing portion 12 is open at one or more ends, which are connected to intermediate hollow sections 11 such that the purification chamber sections 14 of each unit are in flow communication to form a common purification chamber. One or more burners 17 are provided in the purification chamber to heat the gas therein to the required temperature for the efficient destruction of pollutants. The burners may be substituted by any other means to raise temperature, including electric heaters or direct gas injection.

Figure 8B:
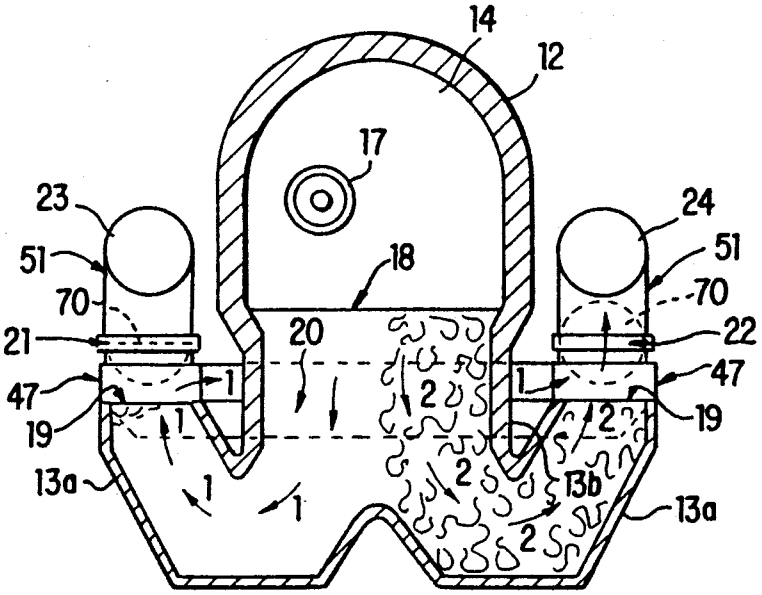
FIG. 8B is a schematic sectional view taken along lines 8—8 of FIG. 2 showing the flow pattern through a regenerative bed of the invention during outlet mode.
Figure 8A:
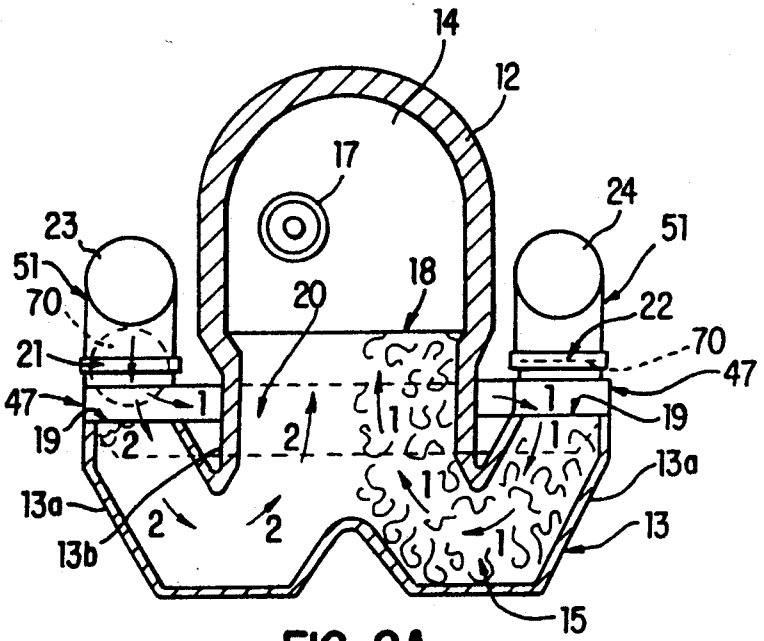
FIG. 8A is a schematic sectional view taken along lines 8—8 of FIG. 2 showing the flow pattern through a regenerative bed of the invention during inlet mode.

The cross-sectional shape of the regenerative bed defined by housing portion 13 is generally designed in the shape of a "w" by provision of two legs 13*a*, which are connected to a central portion 13*b*, as shown in FIGS. 8A–8B. Each leg 13*a* has an open outer end that gradually widens into an inner end uniformly merging with the central portion 13*b*, which is of substantially constant width. The stoneware in the regenerative bed 15 extends from the hot-face area 18 adjacent the purification chamber section 14 to two cold-face areas 19 adjacent the outer ends of legs 13*a*. The hot-face area 18 is defined by the surface of the stoneware 15 closest to the purification chamber 14 while the cold-face areas 19 are defined by the two stoneware surfaces disposed at the furthest points, airflow-wise, from the purification chamber 14. Typically, the stoneware employed in the regenerative beds of the invention are 1- to 3-inch long saddles, which are flat, elbow shaped members that are packed together and interlock. The amount of stoneware employed is based upon the desired percentage of thermal energy recovery for the individual unit. A higher stoneware level (greater amount of stoneware) translates to a lower energy loss. The "w"-shaped cross-sectional design of the bottom housing portion 13 eliminates the necessity for providing members at the hot- and cold-faces of the regenerative bed for retaining the stoneware. Along with the use of interlocking stoneware members, the w-shaped cross-section ensures that the stoneware will not be disturbed or moved after being installed, either by expansion or contraction of the stoneware from heat transfer or from vibration, for example, caused by shipping the regenerative unit with the stoneware in place.

The tapered design of the legs 13*a* produces a cross-sectional flow area that is narrowest at the cold-faces 19 and gradually widens in the direction towards the hot-face 18 until both legs 13*a* merge into the central portion 13*b* of the housing 13, at which point the flow area is relatively constant. This design accommodates for expansion or contraction of gas flowing through the bed to reduce the pressure drop there across and helps reduce variations in air flow path length that must be traversed in the inlet and outlet flow modes.

The two cold-face areas 19 of each regenerative bed are connected by an inlet/outlet crossover duct 20 of the invention, which is illustrated best in FIGS. 1, 6, and 8A–8B. The crossover duct and "w"-shaped cross section of the bed 15 divide flow through the regenerative bed into two flow paths and recombine the divided flow during both inlet and outlet flow modes, as discussed in more detail subsequently. The crossover duct, and other flow ducts as well, are designed to produce equal flow to and from each cold-face area, regardless of whether the unit is operating in inlet or outlet mode. Hence, the crossover duct also helps reduce the variation in air flow path length that must be traversed in the inlet and outlet modes.

The flow of air to and from the regenerative units is controlled by inlet and outlet valves 21 and 22. As shown best in FIGS. 1–2, there is one inlet valve 21 and one outlet valve 22 associated with each regenerative bed 15. The inlet valves 21 communicate with an inlet manifold 23, which receives gas to be processed in the regenerative thermal oxidizer 10, via a specially designed inlet manifold transition duct 51. Typically, this gas is the exhaust from an industrial process, such as paint spraying, that must be treated before venting to the atmosphere. The outlet valves 22 communicate with an outlet manifold 24, also via an outlet manifold transition duct 51, which may be of the same design as the inlet manifold transition duct. The inlet side of an exhaust blower 25 is connected to manifold 24 to draw the process air through the oxidizer 10 via an open outlet valve of one regenerative unit, the purification chamber, and the open inlet valve of another regenerative unit. The blower 25 then pumps the purified air to an exhaust stack 26. As is known in the art, the exhaust fan 25 may be mounted in a housing 27 having means 28 for rotatably supporting the shaft 29 of the blower 25.

FIG. 3 illustrates, in partial cut-away views, the use of refractory material 33 to insulate the inner walls of the regenerative units 10*a*, 10*b*, 10*c*, and the connecting sections 11. A sufficient amount of refractory is used to meet Federal OSHA regulations with respect to skin temperature.

Figure 5:
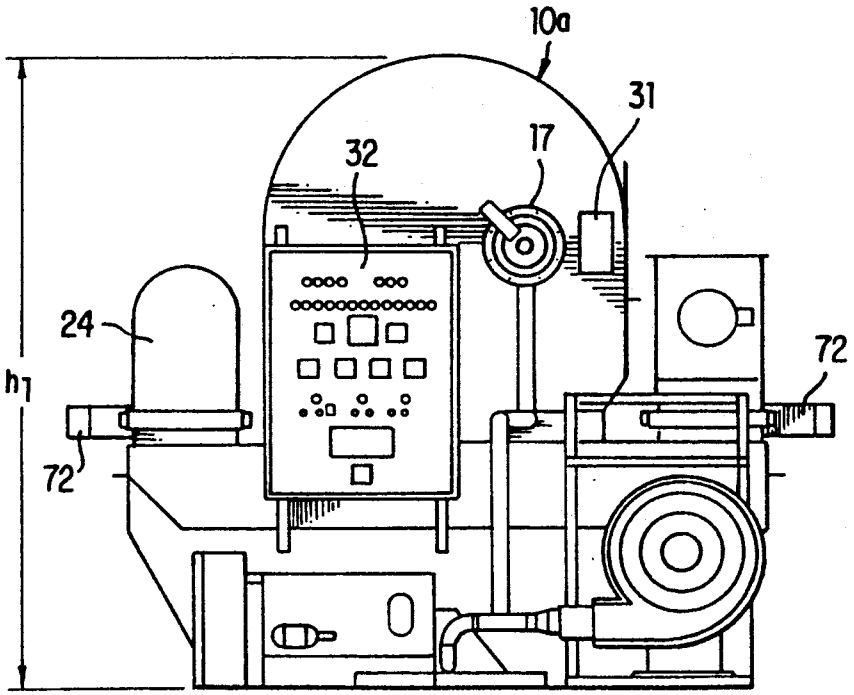
FIG. 5 is a front view of the unit (visible in FIG. 1) in which several of the components that would be mounted on an actual oxidizer are illustrated.
Figure 4:
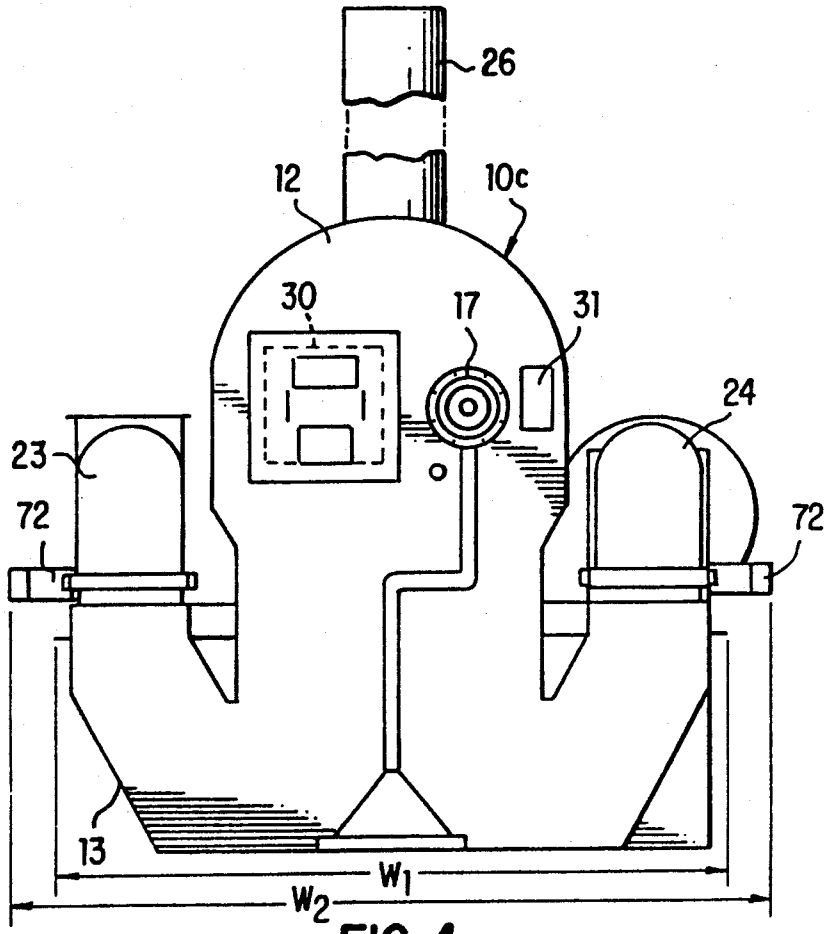
FIG. 4 is an end view of the back of the unit (not visible in FIG. 1) in which an access door to one of the purification chamber sections is shown.

FIG. 4 is an end view of the back of the oxidizer 10, not visible in FIG. 1, in which door 30 is provided to access the purification chamber section 14 of unit 10*c*. The front of the oxidizer, i.e., the front of unit 10*a*, is illustrated in FIG. 5. Several of the components that would be mounted on an actual regenerative oxidizer of the invention, such as electrical transformer 31 and control panel 32, are illustrated therein. FIGS. 4–5 illustrate the particularly compact and modular nature of the regenerative units of the invention. For a 10,000 s.c.f.m. oxidizer, three regenerative units would be employed, each having a width $w_1$, which does not include the valve actuators, of 10 feet-6 inches and an overall width $w_2$ of 12 feet. The overall height $h_1$ including the purification chamber is 10 feet. All of the components necessary for operation maybe mounted on the units in the factory and fit within this 10 foot by 12 foot envelope, thus producing a modular configuration that can easily be shipped by truck and minimizes on-site installation. If greater capacities up to 25,000 s.c.f.m. are required, additional, modular regenerative units may be added without increasing the 10 foot by 12 foot envelope.

Figure 6:
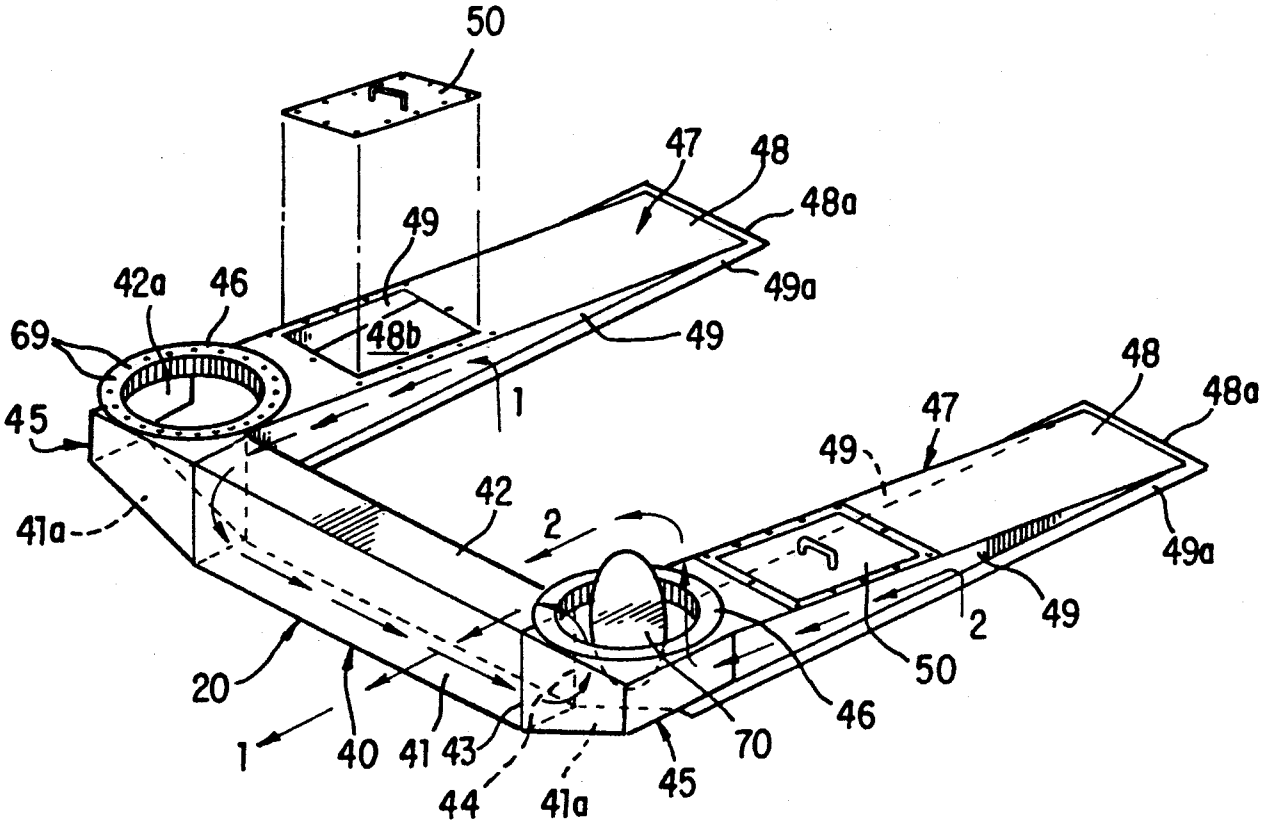
FIG. 6 is a perspective view of an inlet/outlet crossover duct of the invention illustrating its connection to the inlet and outlet manifold valve housings.
Figure 7:
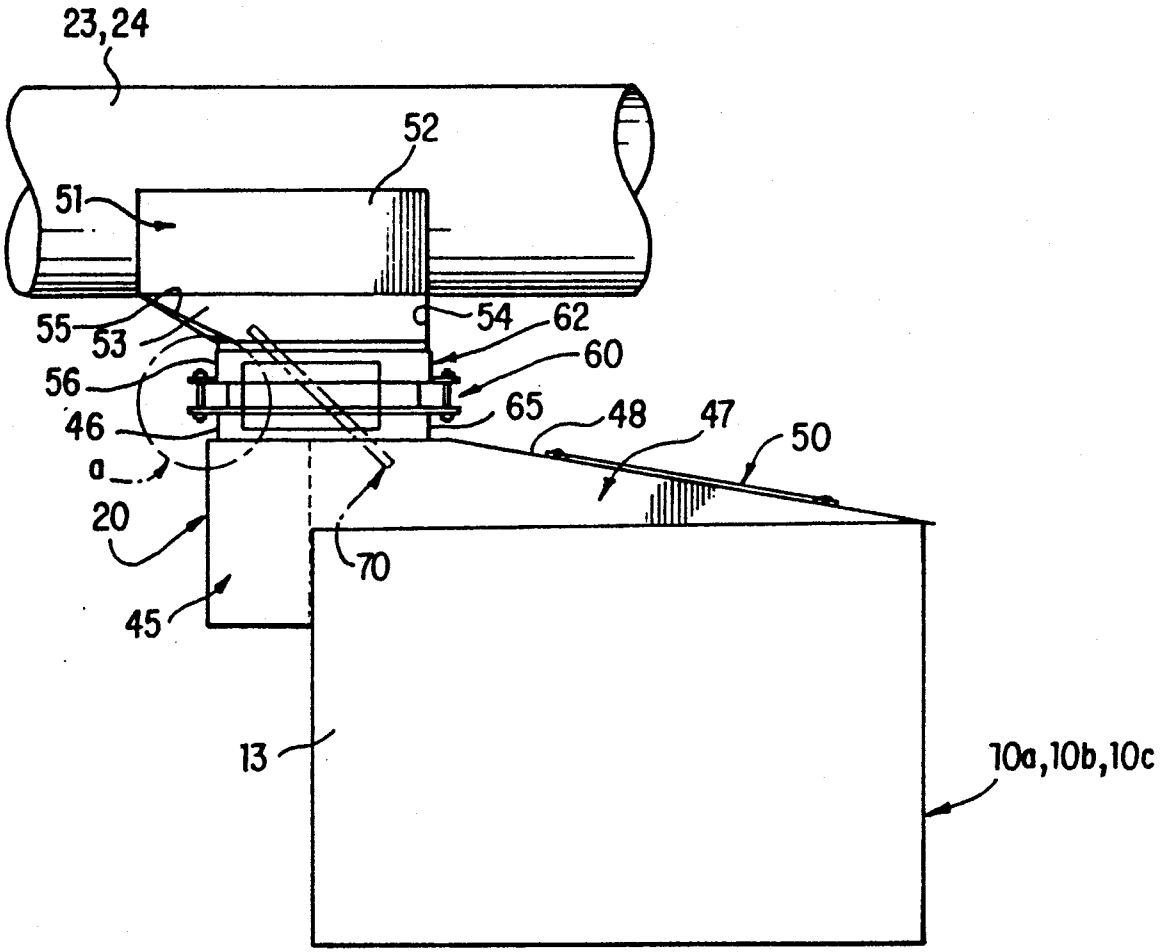
FIG. 7 is a partial elevational view of a regenerative bed of the invention illustrating the connection of the top of a valve housing to one of the inlet and outlet manifolds and the bottom of the valve housing to the crossover duct and regenerative bed.

The structure of the inlet/outlet crossover duct 20 of the invention and the connection of the inlet and outlet valves 21,22 between the inlet and outlet manifolds 23, 24 and regenerative beds can be ascertained from FIGS. 6–7. FIG. 6 is a perspective view of the crossover duct 20, which comprises a first piece of ductwork 40 having a rectangular cross-section defined by a bottom 41, top 42, and opposed sides 43 and 44. The rectangular section 40 of the crossover duct 20 is connected at each opposed open end to end-portions 45, which comprise second pieces of ductwork extending generally uniformly from the open ends of rectangular section 40. One important difference, however, is the slope of the bottom portions 41*a* of each section 45, which are inclined upwardly in a direction away from the ends of tube 20. For the 10,000 s.c.f.m. oxidizer discussed above, bottom portions 41*a* may be sloped at an angle of 30°–45° relative to the horizontal. As explained in more detail subsequently, the upward slope of the bottom 41*a* is one of the measures that helps provide an even air flow distribution through the cold-face areas of the unit in both inlet and outlet modes.

As shown in FIG. 6, the end portions 45 of the crossover duct 20 are open at 42*a* and receive a portion (about half) of the lower valve housing 46 of an inlet or outlet valve 21, 22. The other half of lower valve housing section 46, i.e., the rearward half shown in FIGS. 6–7, is connected to cold-face transition duct 47, which leads to one of the cold-face areas 19 of the regenerative bed. Each cold-face transition duct 47 comprises a wedge-shaped duct having a cross-sectional flow area defined by two triangular sides 49 and a rectangular top 48. The flow area increases in a direction towards the valve housing 60. The top 48 and sides 49 of the wedge-shaped duct 47 are provided with flanges 48*a* and 49*a*, respectively, for connection to a similar flange provided at the open top portion of leg 13*a* (See FIGS. 1 and 7). The top 48 of the transition duct 47 has an opening 48*b* in which an access door 50 is sealingly provided for safe and easy maintenance of the stoneware elements 1. Platforming is not required for access to this door, or to valves 21, 22 for that matter, as the modular regenerative beds have a height typically of 4–6 feet above grade for capacities of 10,000–25,000 s.c.f.m. If it is expected that the stoneware elements may become contaminated during use with non-organic compounds, the stoneware access door may be provided in lower housing portion 13, as illustrated at 50*a* in FIG. 1.

FIG. 7 is a partial elevational view of one of the regenerative beds 10*a*, 10*b*, 10*c* of the invention and illustrates a typical connection of the valve housing 60 of one of the inlet or outlet valves 21, 22 to its respective inlet or outlet manifold 23, 24, and to the crossover duct 20 and cold-face transition duct 47. The valve housing 60 includes a bottom portion 46, valve body 61 shown in FIG. 9, and a top portion 62. The connection of the bottom portion 46 to the end portion 45 of crossover duct 20 and to the top 48 of the transition duct 47 is readily apparent. The top valve housing portion 62 is connected to an inlet or outlet manifold tube 23, 24 by an inlet or outlet manifold transition duct 51, which comprises an upper duct section 52 connected to the manifold 23, 24 and a lower duct section 53 connected to the top portion 62. The lower duct section 53 includes a vertical sidewall 54 and an inclined sidewall 55, typically at an angle of 30° relative to horizontal for a 10,000 s.c.f.m. oxidizer. The section 53 is designed to create equal air flow paths discussed in detail subsequently. FIG. 1 illustrates an optional cold-face transitional duct section in the form of an elbow 23*a*, which may be employed instead of the transition duct 51, to connect a valve 21, 22 to manifold 23, 24. In either case, the transitional duct section is designed to produce equal air flow paths.

Figure 9:
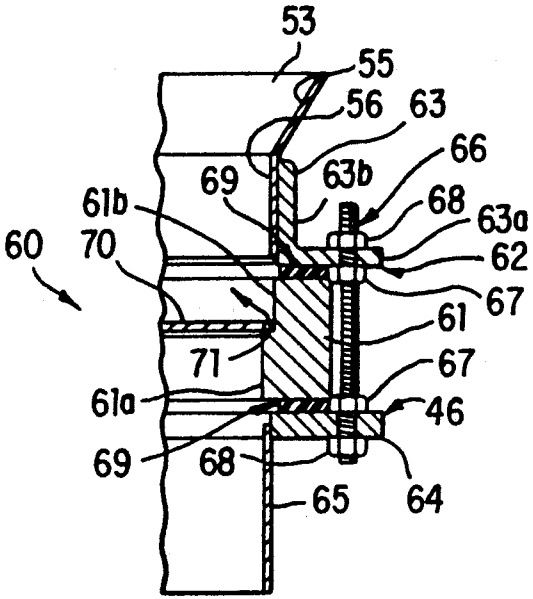
FIG. 9 is an enlarged, partial sectional view of the valve housing detail denoted "a" in FIG. 7.

The structure of valve housing 60 and its connection to duct section 53 and to crossover duct end portion 45 is illustrated in more detail in FIG. 9, which is an enlargement of the Section "a" circled in FIG. 7. FIG. 9 shows the valve body 61 disposed between bottom and top valve housing portions 46 and 62. Lower valve housing portion 46 is formed from an annular flange 64, connected at its inner periphery to a tubular duct section 65, which is connected to the opening in the top portion 42*a* of crossover duct end portion 45 and to an opening in the top 48 of cold-face transition duct 47. This connection is shown best in FIGS. 6–7. The top valve housing portion 62 comprises an annular flange 63, having a first leg portion 63*a* disposed parallel to flange 64 and a second leg portion 63*b* disposed at a right angle to first leg portion 63*a*. Leg portion 63*b* defines an inner opening which the lowermost portion 56 of manifold transition duct 51 is connected. The annular valve body 61 is retained between the two flanges 63 and 64 by a sealed connection made by inserting gasket material 69, such as fiberglass tape or the like, between the upper and lower portions of valve body 61 and the inner sides of flanges 63, 64. The whole valve assembly is secured in place by a plurality of threaded rods 66 and nuts 67, 68. Nuts 68 may be welded to peripherally spaced openings 69 in flange 64 and flange leg portion 63*a*, while nuts 67 may be loose nuts that are appropriately torqued down onto the other sides of the flange 64 and leg portion 63*a* during installation. Other suitable means known in the art for constructing the valves 21, 22 and connecting them to the ducts may be employed instead of the specific structure discussed above.

The valve housing 60 contains a valve member 70 which, as illustrated best in FIG. 7, is rotatable about an axis perpendicular to the plane of the drawing figure. FIG. 9 shows the periphery of the illustrated portion of valve member 70 in a tight metal to metal sealing contact with a step 71 defined between two different inner diameter sections 61*a*, 61*b* of valve body 61. Rotation of the valve in the direction of the arrow shown in FIG. 9 opens the valve by moving valve member 70 away from valve seat 71. Naturally, a similar but opposite-handed valve seat is provided on the diametrically opposed (unillustrated) side of the valve. The valve so described is commonly referred to as a step-seated butterfly valve. One example of such a valve is described in U.S. Pat. No. 4,658,853 to Pennington, the disclosure of which is incorporated by reference herein. Because of its excellent anti-leak features a valve constructed according to this patent is particularly suited for use as the inlet and outlet valves of the regenerative thermal oxidizer of the invention. Other butterfly valves that may be used in the invention are disclosed in U.S. Pat. Nos. 4,248,841 and 4,252,070 to Benedick. However, as is readily apparent to one of ordinary skill in the art, still other types of valves or flow dividing mechanisms may be employed instead of the butterfly valves discussed above.

Regardless of the type of valve mechanism used, the valves may be operated by a hydraulic, pneumatic, or electrical actuator, such as 72 shown in FIGS. 1–2, or by other suitable means. In operation, the valves 21,22 operate similarly except one is connected to the inlet manifold inlet while the other is connected to the outlet manifold. In either case, the valve is fully closed when valve member 70 is in its horizontal position abutting shoulder seat 71. Valve member 70 is shown in a partially open position in FIG. 7 and in its fully open vertical position in FIG. 2 at 21 and in FIG. 6. As can be appreciated from FIGS. 6–7, in the fully open position the valve member 70 essentially divides in half the air plenum defined by crossover duct portion 45 and transition ducts 47 and 51. In both inlet and outlet modes of operation, air is conducted between the hot-face area 18 and the cold-face areas 19 via two separate flow paths. One path is directly via one of the cold-face areas and an open inlet or outlet valve, and the other is via the other cold-face area 19 and the crossover duct 20. The flow paths 1 and 2 sketched in FIGS. 6 and 8B illustrate the flow division feature when a regenerative unit is in an outlet mode, i.e., when oxidized air from the purification chamber 14 is being cooled as it flows through a regenerative bed 15 to the outlet manifold 24 for exhaust. Starting with FIG. 8B, air from the purification chamber 14 flows through bed portion 13*b* and is divided by legs 13*a* into two flowpaths 1 and 2. The legs 13*a* conduct the gas to the two cold-face areas 19. Flow path 1 in FIG. 6 tracks the flow from one cold-face area 19 via duct 47, underneath a closed or horizontal valve member 70 of an inlet valve 21 (not shown in FIG. 6, but see FIG. 8B), the crossover duct 20, and the near side of the open outlet valve 22, into the outlet manifold 24. The second flow path 2 shown in FIG. 6 is the more direct path emanating from the other cold-face area 19 and leading via the other duct 47 to the right or far side of the open valve member 70 of outlet valve 22, and into the outlet manifold 24. The arrows in FIG. 8A have been designated with the numerals 1 and 2 to show the flow paths during inlet mode as well. As shown in FIG. 8A, the positions of the inlet and outlet valves are reversed (inlet valve 21 is open and outlet valve 22 now is closed) and the air flows via paths 1 and 2 in the opposite direction, i.e., from the cold-face areas 19 to the purification chamber 14.

To provide for the most efficient heat exchange in the regenerative bed, the flow rate via each of these flow paths—that is, that quantity of air being processed per time—should be substantially the same. Otherwise, one side of the regenerative bed would operate at a higher temperature than the other. In general, a poorly designed manifold system will allow up to 10% variance in flow rates at maximum flow. In the invention, the variance between flow rates should not be more than 3% , with as close to 0% as possible being preferred.

To balance the air flow and ensure an even pressure drop, regardless of flow path, several steps were taken to facilitate flow through the crossover duct and hamper flow directly via the valve above the cold-face. Without these measures, the air flow rate via the direct flow path would be greater because it is generally a shorter and easier path than that through the crossover duct. The first measure taken is shown best in FIGS. 6–7, which illustrate the cross-sectional flow area of crossover duct 20 being larger than that of transition duct 47. The second measure taken is decreasing the height of the valve body portion 65, shown in FIGS. 7 and 9. As the length of valve body portion 65 is decreased, the cross-sectional flow area of transition duct 47 is decreased at a greater rate than that of crossover duct 20, due to the wedge shape of duct 47. The third item concerns the orientation of crossover duct 20, which is designed to help direct the flow into the lower valve housing portion 60. As discussed previously, FIG. 6 shows the bottoms 41*a* of end portions 45 being sloped upwardly towards the valve body. This gives the air flowing via path 1 a larger radius to turn into and thus facilitates flow of the air from duct 20 into the valve. Contrary thereto, the air flowing via path 2 from cold-face area has a more difficult time flowing into the valve because transition duct 47 restricts the air. In duct 47, the air is being conducted at approximately the same elevation as the valve housing and must make a sharp, almost 90° turn upwardly to flow through the valve. The last measure concerns transition duct 52, which also has been designed to favor air flow from the crossover duct 20 rather than from transition duct 47. As can be visualized from FIG. 7, when, for example, the outlet valve is open (outlet mode), air from duct 47 flows through the right side of the valve, along straight wall section 54, and must make a 90° turn to exhaust into manifold 24. However, air coming from the left side of the valve via crossover duct 20 does not make the same sharp 90° turn, because of inclined section 55, typically at 30° to the horizontal, which guides the air in a more gentle manner and presents a greater area through which the air may flow. Likewise, in the inlet mode, as air flows in the reverse direction from the inlet manifold 23 into the valve 21, it is easier for the air to flow into crossover duct 20 than into transition duct 47 because of the aforementioned difference in slopes between sections 53 and 54.

The overall operation of the regenerative thermal oxidizer of the invention, which should be readily apparent from the above description, is set forth below. Each regenerative unit 10*a*, 10*b*, and 10*c* has an associated inlet duct, outlet duct, and one inlet/outlet crossover duct 20. The inlet duct includes an inlet valve 21 and an inlet manifold transition duct 51 communicating the valve 21 with the inlet manifold 23. The outlet duct includes an outlet valve 22 and an outlet manifold transition duct 51 communicating the valve 22 with the outlet manifold 24. Duct 20 is connected between the inlet and outlet valves 21, 22 and forms part of the inlet duct during inlet mode and part of the outlet duct during outlet mode. The regenerative units are operated in a cyclical fashion between inlet and outlet mode following a predetermined time cycle in which one unit is always in inlet mode, one unit is in outlet mode, and the third unit is either an inlet mode, outlet mode, or a dead mode in which both inlet and outlet valves are closed as the third unit changes from one mode to another. During the dead mode, a flushing operation occurs to prevent untreated gases from being exhausted. Thus, shortly after one unit switches from outlet to inlet mode, the other unit already in inlet mode will switch to outlet. Shortly after this, the chamber already in outlet mode will switch to inlet mode and the pattern will follow as such. The cyclical pattern of operation incorporating a dead mode is necessary to maintain a high thermal energy recovery, insure a smooth mode transition, and reduce the pressure spikes associated with two regenerative bed units. Due to the modular construction of the unit 10, it is possible to have larger oxidizers with five or more regenerative chambers to handle greater flows without increasing the height or width of the units. To achieve the highest efficiencies in this type of oxidizer, there should be an odd number of chambers so that half of the chambers will always be in inlet mode, half in outlet mode, and the odd chamber in any of the three phases of operation.

The unit in outlet mode stores heat as it cools the oxidized air flowing from the purification chamber. This heat is used when the unit switches to inlet mode to preheat the incoming process fumes. Through the use of suction from the exhaust fan 25, process air is pulled from its source(s) into the inlet manifold 23. With reference to FIGS. 2, 7 and 8A, the process air flows through the inlet manifold until it enters the open valve 21 of a regenerative unit in inlet mode, for example, unit 10*b* in FIG. 2. The valve member 70 is oriented vertically (although any valve orientation or flow dividing arrangement that divides the air flow in half may be used as discussed previously) so that half of the flow passes through the crossover duct 20 to the cold-face area 19 under the closed outlet valve 22 (see arrows 1 in FIG. 8A) and half flows to the other cold-face area 19 directly under the inlet manifold 23 (see arrows 2 in FIG. 8A). The process air is evenly divided into both legs 13*a* of the regenerative bed 15. The divided flow is recombined in the regenerative bed at central portion 13*b*. The stoneware in the bed heats the process air to a temperature close to that of the purification chamber 14, by virtue of the previous preheating process discussed above. After the flow passes from the regenerative bed 15 through the hot-face area 18 into the purification chamber 14, the burners 17 maintain the temperature at the oxidization levels typically ranging from 1500° F. to 1800° F. The oxidized air is then pulled via one or more connecting sections 11 through the hot-face area 18 of a unit in outlet mode, for example, unit 10*c*.

FIG. 8B illustrates the outlet mode in which the inlet valve 21 is closed and the outlet valve 22 is open. As shown in FIG. 8B, the flow from the purification chamber divides evenly by virtue of the two legs 13*a* in the regenerative bed to exit through both of the cold-face areas 19. The purified gas is cooled as it passes through a regenerative bed in outlet mode by virtue of heat transfer from the oxidized air to the stoneware in the bed. Because valve 21 is closed, the gas flowing via path 1 in FIG. 8B is conveyed under the valve, into crossover duct 20, and valve 22. The gas flowing via path 2 is conveyed directly via the other leg 13*a* to the other side of open valve 22, as best illustrated perhaps in FIG. 6. The two flow paths then rejoin as the gas flows past the valve 22, into transition duct 51, and outlet manifold 24. From manifold 24, the purified exhaust gas proceeds through the outlet manifold, blower 25, and finally the stack 26.

The tapered design of legs 13*a* helps reduce any variation in air flow path length by providing a greater cross-sectional flow area, as the temperature of the gas increases when it flows from the cold-face area 19 to the hot-face area 18, or a decreasing cross-sectional flow area as the gas flows from hot-face area 18 to cold-face 19 area. In other words, the tapered flow areas of legs 13*a* provide additional room for the gas to expand as it is heated by the stoneware in the inlet mode (FIG. 8A), and reduces the flow path as the gas cools and contracts in the outlet mode (FIG. 8B).

To increase the pollutant destruction efficiency, a small flushing valve 34 can be connected to each of the crossover ducts 20, as illustrated in FIGS. 2–3. The flushing valves may also be of the butterfly-type, but need not incorporate any anti-leakage features. The valve 34 may be positioned intermediate the length of the crossover duct 20 and like valves 21, 22 may be actuated by any suitable hydraulic, pneumatic or electric means. During the dead mode between inlet and outlet modes when both valves 21, 22 are closed, valve 34 opens to allow ambient air to be pulled through the regenerative bed by blower 25 and flush any process fumes not yet incinerated through the crossover duct 20, transition ducts 47, and bed 15. Alternately, the valves 34 may be connected to the exhaust stack 26 for using purified gas as the flushing air. In either case, disposing the valve 34 in a position intermediate the crossover duct 20 produces a split in the flushing air flow, which results in more efficient flushing than with the single flushing air flow of the prior act. The sloped bottoms 41*a* of the crossover duct portions 45 also aid in reducing the volume to be flushed, as does the tapered nature of transitions 47. Due to the compact design of the regenerative units 10*a*, 10*b*, and 10*c*, the minimum flushing volume of each unit is very small, typically 32 cubic feet for a 10,000 s.c.f.m. capacity oxidizer. Using the minimum flushing volumes of 80 and 37 s.c.f.m., set out previously for 10,000 s.c.f.m. vertical can and horizontal flow oxidizers, respectively, the minimum flushing volume of the invention is generally 40–50% less than that of a vertical can oxidizer and 10–15% less than that of a horizontal flow oxidizer of comparable capacity.

Figure 12:
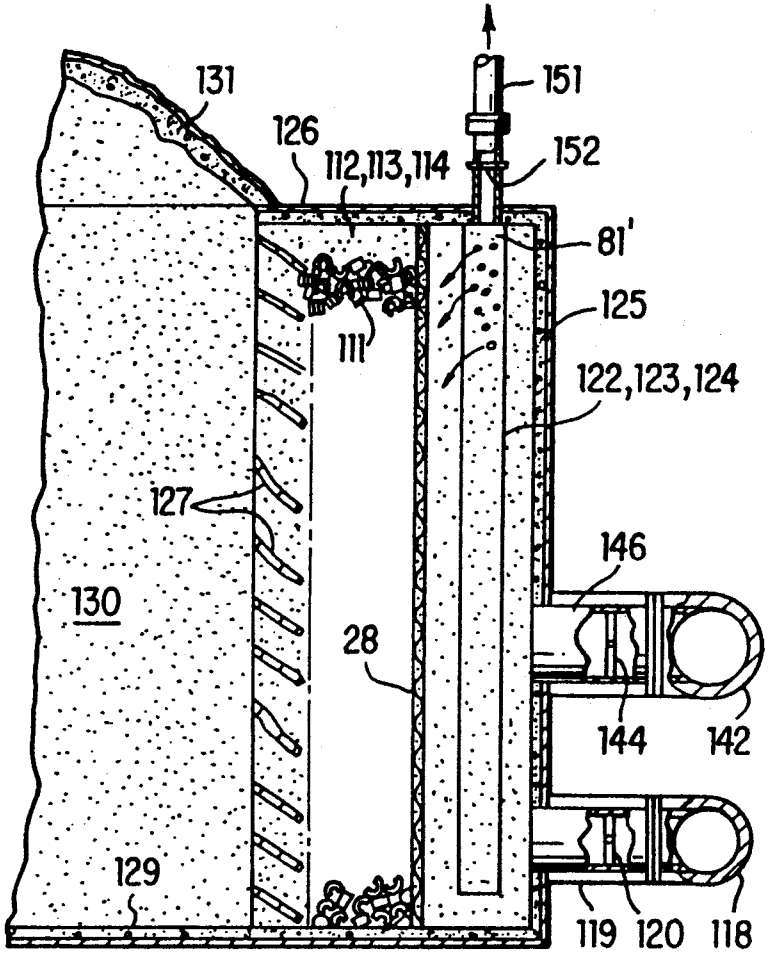
FIG. 12 PRIOR ART
FIG. 12 is a schematic sectional view of a conventional, horizontal flow type oxidizer illustrating the use of a baffle tube to distribute flushing air.
Figure 11:
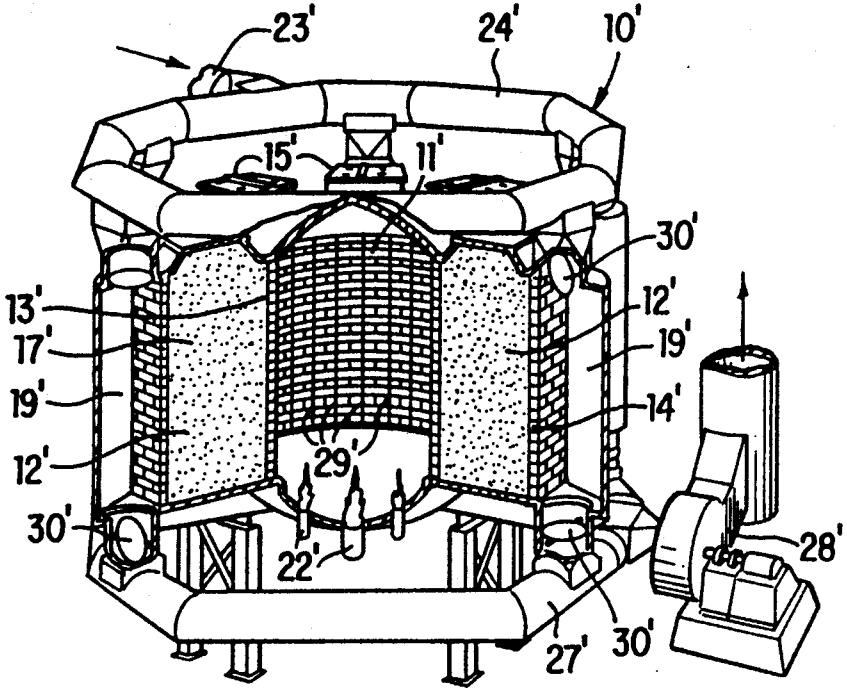
FIG. 11 PRIOR ART
FIG. 11 is a schematic perspective view, partially broken away, of a conventional, horizontal flow type regenerative oxidizer.
Figure 14:
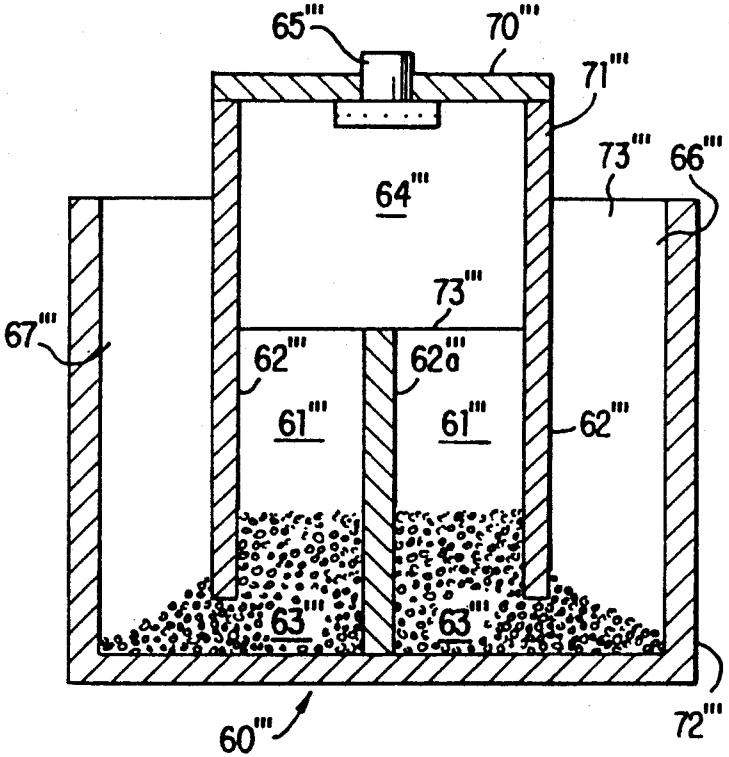
FIG. 14 PRIOR ART
FIG. 14 is a sectional view of an embodiment of a regenerative thermal oxidizer proposed in U.S. Pat. No. 3,634,026.
Figure 13:
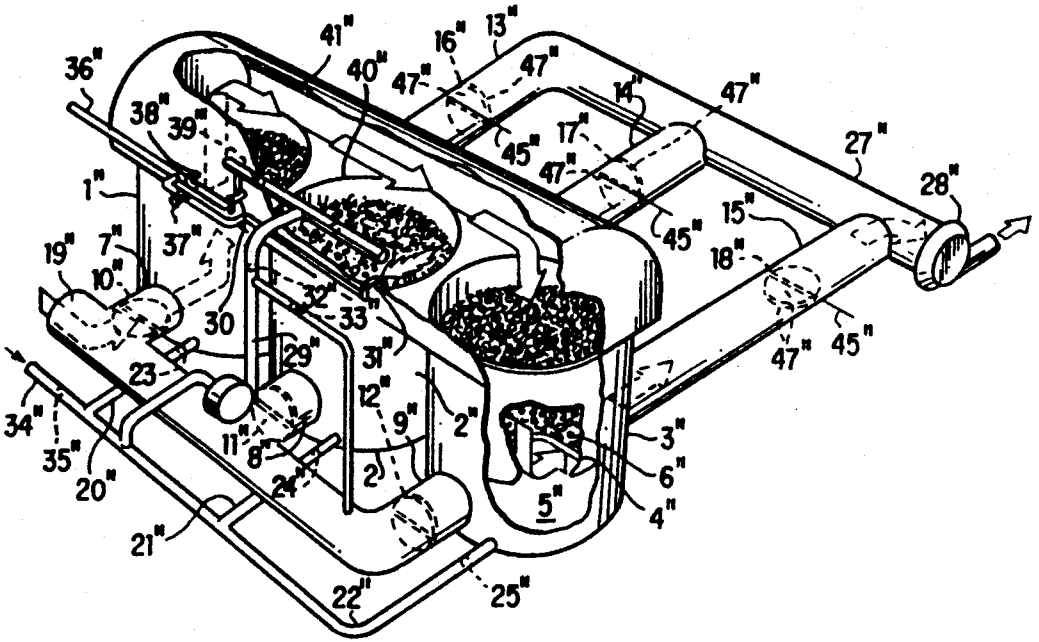
FIG. 13 PRIOR ART
FIG. 13 is a perspective view, partially broken away, of a conventional, vertical flow type regenerative oxidizer.

Transitions 47 also produce a significant advantage over the horizontal flow-type oxidizer, which as illustrated in FIG. 12 at 81, typically require a vertical distribution baffle for distributing the flushing air along the length of the cold face. The tapered nature of the cold-face transition duct 47 (as indicated in FIG. 6) obviates the need for such a distribution baffle because as the flushing volume flows from the duct 20, underneath closed valves 21, 22, to the duct 47, the continually reducing cross-sectional flow area of duct 47 tends to spread out the flushing air by increasing the backpressure. This also tends to force the flushing air into the stoneware sooner than if the duct 47 was not tapered.

Figure 10:
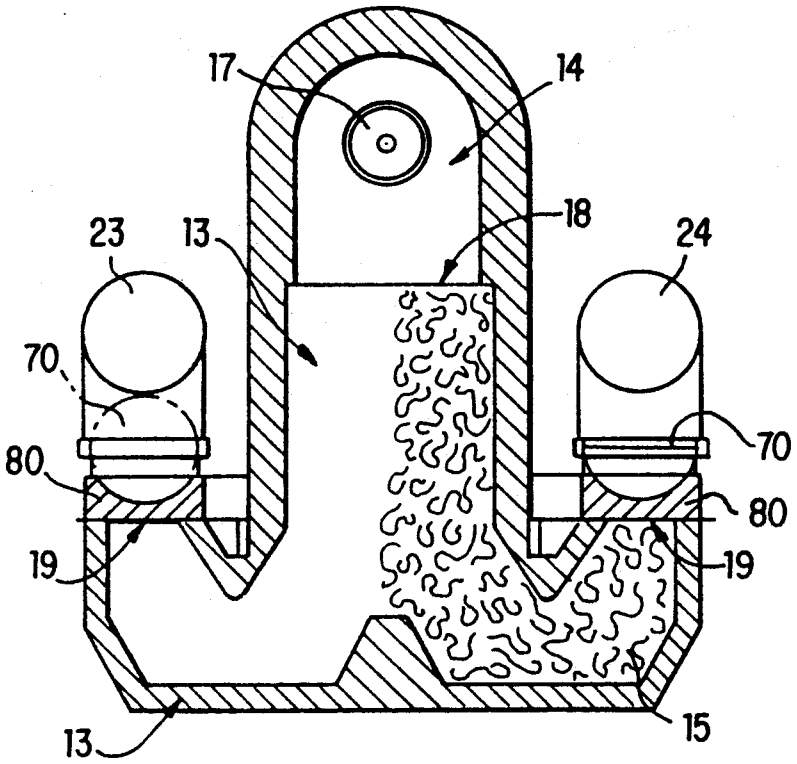
FIG. 10 is a schematic sectional view of a regenerative bed of the invention illustrating the use of optional flow dividers disposed between the regenerative bed and manifold valves.

FIG. 10 illustrates the use of an optional, semi-circular flow divider 80, which is positioned directed underneath valve member 70 to assist the valve member 70 in dividing the two flow paths when in its open vertical position (see paths 1 and 2 in FIG. 6). The use of such a flow divider equalizes flow volume from paths 1 and 2, prevents the gas in the two flow paths from intermixing underneath the valve, and may be particularly advantageous when a step seated butterfly valve of the type described in U.S. Pat. No. 4,658,853 is not employed.

What is claimed is:

1. A regenerative thermal apparatus for oxidizing pollutants in an industrial exhaust gas flow comprising:

(a) a purification chamber having at least one source of heat for maintaining a temperature high enough to oxidize pollutants contained in the exhaust gas flow;

(b) at least two regenerative heat recovery units of modular construction, each unit being capable of operating in an inlet flow mode in which gas is conducted from the exhaust gas flow through the unit to the purification chamber and an outlet flow mode in which gas is conducted from the purification chamber through the unit, each regenerative unit comprising:

(i) a first housing portion defining part of the purification chamber;

(ii) a second housing portion having a bed of heat-exchange elements defining at least two separate cold-face areas and at least one hot-face area disposed remote from said cold-face areas with respect to the direction of flow, said second housing portion further having at least two first openings, with each cold-face area being disposed adjacent one of said first openings, and at least one second opening being disposed adjacent said at least one hot-face area, said at least one second opening being in flow communication with said purification chamber; and (iii) an inlet duct for conducting gas to the cold-face areas during the inlet flow mode, said inlet duct including a selectively operable, inlet valve mechanism having an open position communicating the inlet duct with said first openings;

(iv) an outlet duct for conducting gas away from the cold-face areas during the outlet flow mode, said outlet duct including a selectively operable, outlet valve mechanism having an open position communicating the outlet duct with said first openings; and (v) a crossover duct communicating with said inlet and outlet ducts such that the crossover duct forms part of the inlet duct during the inlet flow mode and part of the outlet duct during the outlet flow mode;

(c) an inlet manifold for conducting gas from the exhaust gas flow to the inlet ducts of said regenerative heat recovery units;

(d) an outlet manifold for conducting gas from the outlet ducts of said regenerative heat recovery units to atmosphere; and wherein said valve mechanisms are operable to conduct gas from said inlet manifold to the inlet duct and the crossover duct of one of said regenerative units operating in the inlet flow mode during which the exhaust gas is preheated as it flows through said one regenerative unit to the purification chamber where it is oxidized and then flows from the purification chamber through the crossover duct and the outlet duct of another of the regenerative units operating in the outlet flow mode in which the oxidized gas is cooled as it flows from the purification chamber through said other regenerative unit to the outlet manifold.

2. The regenerative thermal oxidizer of claim 1 further comprising a valve controller operable to cyclically reverse the positions of the valve mechanisms and the direction of gas flow through the apparatus whereby said other regenerative unit now functions in the inlet flow mode and said one regenerative unit functions in the outlet flow mode, with heat transfer to a regenerative unit in outlet flow mode preheating exhaust gas conducted thereto when this regenerative unit switches to inlet flow mode.

3. The regenerative thermal oxidizer of claim 1 wherein each inlet valve mechanism comprises an inlet flow dividing mechanism for dividing flow from said inlet manifold into two inlet flow paths conducting gas to the cold-face areas at substantially equal flow rates, with the first inlet flow path conducting gas from the inlet manifold to one of the cold-face areas via said inlet flow dividing mechanism and the second inlet flow path conducting gas from the inlet manifold to the other cold-face area via said inlet flow dividing mechanism and said crossover duct, and wherein each outlet valve mechanism comprises an outlet flow dividing mechanism for conducting gas oxidized in said purification chamber away from said cold-face areas via two outlet flow paths at substantially equal flow rates, with the first outlet flow path conducting gas from one of the cold-face areas via said outlet flow dividing mechanism and the second outlet flow path conducting gas from the other cold-face area via said crossover duct and said outlet flow dividing mechanism.

4. The regenerative thermal oxidizer of claim 3 wherein the inlet valve of each regenerator unit is in its open flow dividing position during the inlet mode and in its closed position during the outlet mode and the outlet valve of each regenerator unit is in its open flow dividing position during the outlet mode and in its closed position during the inlet mode.

5. The regenerative thermal oxidizer of claim 4 wherein said inlet and outlet valves comprise step-seated butterfly valves.

6. The regenerative thermal oxidizer of claim 4 further comprising a stationary, flow divider disposed adjacent each inlet and outlet valve for maintaining the flow paths separate when its associated valve is in the open position.

7. The regenerative thermal oxidizer of claim 3 wherein each regenerative unit further comprises a first, cold-face transition duct communicating with one of the cold-face areas and the inlet flow dividing mechanism and a second, cold-face transition duct communicating with the other cold-face area and the outlet flow dividing mechanism, said crossover duct communicating with the inlet and outlet flow dividing mechanisms such that the first inlet flow path comprises the first cold-face transition duct and the inlet flow dividing mechanism, the second inlet flow path comprises the second cold-face transition duct, the crossover duct, and the inlet flow dividing mechanism, the first outlet flow path comprises the second cold-face transition duct and the outlet flow dividing mechanism, and the second outlet flow path comprises the first cold-face transition duct, the crossover duct, and the outlet flow dividing mechanism.

8. The regenerative thermal oxidizer of claim 7 wherein said inlet duct further comprises an inlet manifold transition duct communicating with the inlet manifold and the inlet flow dividing mechanism and said outlet duct further comprises an outlet manifold transition duct communicating with the outlet manifold and the outlet flow dividing mechanism.

9. The regenerative thermal oxidizer of claim 8 wherein the crossover duct, first and second cold-face transition ducts, and the inlet and outlet manifold transition ducts have cross-sectional flow areas selected to produce substantially equal flow rates for gas conducted via the first and second inlet flow paths, and for gas conducted via the first and second outlet flow paths.

10. The regenerative thermal oxidizer of claim 9 wherein the crossover duct is connected underneath the inlet and outlet flow dividing mechanisms and comprises a duct of generally rectangular cross-section having opposed end portions with bottom floors sloping upwardly toward the flow dividing mechanisms.

11. The regenerative thermal oxidizer of claim 10 wherein the first and second cold-face transition ducts are connected between one of the cold-face areas of the regenerative bed and one of the inlet and outlet flow dividing mechanisms such that the cross-sectional flow areas of the first and second cold-face transition ducts each are substantially less than that of the crossover duct and increase in a direction toward the inlet and outlet flow dividing mechanisms.

12. The regenerative thermal oxidizer of claim 11 wherein the inlet and outlet manifold transition ducts have cross-sectional flow areas that are selected relative to each other favor flow through the crossover duct and hamper flow through the cold-face transition ducts.

13. The regenerative thermal oxidizer of claim 12 wherein the inlet and outlet manifold transition ducts each comprise an outer section connected to the inlet and outlet manifolds, respectively, and an inner section connected to the inlet and outlet flow dividing mechanisms, respectively, said inner section including an inclined wall favoring flow through the crossover duct and a vertical wall hampering flow through the cold-face transition ducts.

14. The regenerative thermal oxidizer of claim 1 wherein each regenerative bed has a cross-section formed by two legs each having an outer end in which one of said two cold-face areas is provided and an inner end uniformly merging into a central portion in which said hot-face area is provided, and wherein said heat-exchange elements comprise interlocked stoneware, said legs and central portion of the regenerative bed forming the sole means of supporting and containing the stoneware.

15. The regenerative thermal oxidizer of claim 14 wherein the legs gradually taper outwardly in a direction from their outer to inner ends to provide an increasingly larger cross-sectional flow area for gas flowing toward the hot-face during inlet mode and a decreasingly smaller cross-sectional flow area for gas flowing toward the cold-faces during outlet mode.

16. The regenerative thermal oxidizer of claim 15 wherein each regenerative unit has a height no greater than 10 feet and a width no greater than 12 feet, and the capacity of the oxidizer is at least 10,000 s.c.f.m. with a heat recovery efficiency of up to about 95%.

17. The regenerative thermal oxidizer of claim 1 further comprising a selectively operable, flushing valve connected to the crossover duct, said flushing valve having an open position permitting a flushing volume of gas to flow through the crossover duct via separate flow paths, each leading to one of the cold-face areas for purging the crossover duct and regenerative bed of unpurified gas.

18. In a regenerative thermal apparatus having means for oxidizing pollutants in an industrial exhaust gas flow, and at least two regenerative beds for conducting gas to and from said purification chamber in which the direction of flow through the beds is periodically reversed, the improvement comprising each regenerative bed having a cross-sectional shape containing interlocked heat-exchange elements supported solely by the cross-sectional shape of the bed, said cross-sectional shape being defined by at least two legs having open outer ends and inner ends merging into a central portion and wherein the heat exchange elements extend from separate cold-face areas adjacent the outer ends of the legs to a hot-face area disposed at a position most remote from said cold-face areas with respect to the direction of gas flow through the regenerative bed, said legs and central portion changing the direction of flow as gas is conducted between the hot- and cold-face areas.

19. The apparatus at claim 18 wherein the leg portions gradually taper outwardly in a direction from their outer to inner ends to automatically provide an increasingly larger cross-sectional flow area for gas flowing toward the hot-face area during inlet mode and a decreasingly smaller cross-sectional flow area for gas flowing toward the cold-face area during outlet mode.

20. The apparatus of claim 19 wherein each regenerative bed further includes a crossover duct communicating with the two cold-face areas.

21. The apparatus of claim 20 wherein each regenerative bed further comprises:

an inlet valve communicating with one of said cold-face areas, said inlet valve having an open position for conducting gas directly to said one cold-face area and indirectly to the other cold-face area via the crossover duct during an inlet mode when gas is conducted from the cold-face areas to the hot-face area; and an outlet valve communicating with said other cold-face area, said outlet valve having a closed position permitting gas from the crossover duct to pass into said other cold-face area during said inlet mode and an open position for conducting gas flowing directly from said other cold-face area and indirectly from said one cold-face area via said crossover duct during an outlet mode when gas is conducted from the hot-face area to the cold-face areas, and said inlet valve also having a closed position permitting gas from the crossover duct to pass from said one cold-face area into the crossover duct during said outlet mode.

22. The apparatus of claim 21 wherein each regenerative bed is of modular construction and comprises a purification chamber section defining at least a part of said purification chamber and being disposed adjacent said hot-face area.

23. The apparatus of claim 22 wherein three regenerative units are provided, each having a height no greater than 10 feet and a width no greater than 12 feet, with the capacity of the apparatus being at least 10,000 s.c.f.m. and achieving a heat recovery efficiency of up to about 95%.

24. A regenerative thermal apparatus for oxidizing pollutants in an industrial exhaust gas flow comprising:

(a) means for heating gas to be purified to a temperature high enough to oxidize pollutants contained therein;

(b) at least two regenerative units, each comprising a housing portion having a regenerative bed of heat-exchange elements defining at least two separate cold-face areas and at least one hot-face area disposed remote from said cold-face areas, said housing portion having at least two first openings, with each cold-face area being disposed adjacent one of said first openings, and at least one second opening being disposed adjacent said at least one hot-face area and being in flow communication with said purification chamber;

(c) means for conducting gas to be purified through said at least two first openings to the cold-face areas of one of the regenerative units operating in an inlet mode in which gas flows through said one regenerative unit to said purification chamber;

(d) means for conducting oxidized gas from said purification chamber through said at least one second opening, said at least one hot-face area, and said cold-face areas of another of the regenerative units operating in an outlet mode in which the oxidized gas flows through said other regenerative unit, said other regenerative unit cooling the oxidized gas by virtue of heat transfer to the heat-exchange elements contained therein; and (e) means for cyclically reversing the direction of gas flow through the apparatus whereby said other regenerative unit now functions as an inlet regenerative unit and said one regenerative unit functions as an outlet regenerative unit, with heat transfer to a regenerative unit in outlet mode preheating unpurified gas conducted thereto when this regenerative unit switches to inlet mode.

* * * * *